US007549838B2

(12) United States Patent
Touyeras

(10) Patent No.: US 7,549,838 B2
(45) Date of Patent: Jun. 23, 2009

(54) TAKING AIR AWAY FROM THE TIPS OF THE ROTOR WHEELS OF A HIGH PRESSURE COMPRESSOR IN A TURBOJET

(75) Inventor: Armel Touyeras, Combs La Ville (FR)

(73) Assignee: Snecma, Paris (FR)

( * ) Notice: Subject to any disclaimer, the term of this patent is extended or adjusted under 35 U.S.C. 154(b) by 330 days.

(21) Appl. No.: 11/349,123

(22) Filed: Feb. 8, 2006

(65) Prior Publication Data

US 2006/0182623 A1 Aug. 17, 2006

(30) Foreign Application Priority Data

Feb. 16, 2005 (FR) ..... 05 01567

(51) Int. Cl.
*F01D 25/24* (2006.01)

(52) U.S. Cl. ..... 415/144; 415/914

(58) Field of Classification Search ..... 415/144, 415/58.7, 58.5, 914, 181
See application file for complete search history.

(56) References Cited

U.S. PATENT DOCUMENTS 3,993,414 A 11/1976 Meauze et al.
4,479,755 A 10/1984 Skoe
5,707,206 A * 1/1998 Goto et al. ..... 415/914
6,514,039 B1 * 2/2003 Hand ..... 415/58.5
7,147,426 B2 * 12/2006 Leblanc et al. ..... 415/58.5

FOREIGN PATENT DOCUMENTS

EP 1 103 725 A2 5/2001
FR 2 669 687 A1 5/1992
GB 2 158879 A 11/1985

* cited by examiner

*Primary Examiner*—Richard Edgar
(74) *Attorney, Agent, or Firm*—Oblon, Spivak, McClelland, Maier & Neustadt, P.C.

(57) ABSTRACT

A turbomachine compressor comprises at least one plurality of moving blades and spaced apart therefrom in an axial direction relative to a central longitudinal axis of the turbomachine, a plurality of stationary vanes, and a stationary casing surrounding said plurality of moving blades and including a plurality of bleed holes centered in the range 5% to 50% of the blade chord length and having a diameter less than or equal to 30% of the blade chord length, each bleed hole sloping at two angles of inclination relative to the central longitudinal axis. Advantageously, each bleed hole has a first axis of inclination presenting an angle $\phi$ relative to the central longitudinal axis lying in the range 30° to 90°, and a second axis of inclination perpendicular to the first and presenting an angle $\theta$ relative to the central longitudinal axis lying in the range 30° to 90°.

21 Claims, 3 Drawing Sheets

TAKING AIR AWAY FROM THE TIPS OF THE ROTOR WHEELS OF A HIGH PRESSURE COMPRESSOR IN A TURBOJET

FIELD OF THE INVENTION

The present invention relates to the specific field of turbomachines, and it relates more particularly to a device for bleeding air from the air flow channel in a high pressure axial compressor of such a turbomachine.

PRIOR ART

In the high pressure axial compressors of turbojets for turboprops (referred to below as "turbomachines"), it is known that the clearance that exists between the tips of the moving blades of the compressor and the casing forming the inside wall of the air flow channel degrades the drive efficiency of the turbomachine. In addition, this clearance can significantly modify and degrade the operation of the compressor to the extent of a so-called "pumping" phenomenon appearing. One solution to that problem is given in French patent No. 2 564 533 which, in order to avoid pumping in an axial compressor, describes a specific way of shaping the casing in association with a specific arrangement of an air flow system. That arrangement is nevertheless relatively complex and difficult to implement.

OBJECT AND SUMMARY OF THE INVENTION

An object of the present invention is to provide a turbomachine compressor enabling a significant improvement compared with prior art devices to be obtained in efficiency and in the operating safety margin with respect to pumping, also referred to as the "pumping margin".

These objects are achieved by a turbomachine compressor comprising of moving blades and, spaced apart therefrom in an axial direction relative to a central longitudinal axis of the turbomachine, a plurality of stationary vanes, and a stationary casing surrounding said plurality of moving blades, wherein said stationary casing includes a plurality of bleed holes centered in the range 5% to 50% of the blade chord length and of a diameter less than or equal to 30% of said blade chord length, each of said bleed holes sloping at two angles relative to said longitudinal central axis.

Thus, with this configuration for taking air away from the tips of the moving blades, the pumping margin is increased and efficiency is significantly improved.

Preferably, the ratio between the total air flow rate through the turbomachine and the bled-off air flow rate lies in the range 0.1% to 5%.

In an advantageous embodiment, said stationary casing further includes oblique tongues disposed in register with said plurality of moving blades on either side of each bleed hole and oriented at said angle $\phi$.

Advantageously, each of said bleed holes has a first axis of inclination presenting an angle $\phi$ relative to the central longitudinal axis lying in the range 30° to 90°, and a second axis of inclination perpendicular to the first and presenting an angle $\theta$ relative to the central longitudinal axis lying in the range 30° to 90°.

In the intended embodiment, said bleed holes can be disposed in a staggered configuration or they can be formed by axially symmetrical slots. These bleed holes may also be non-circular.

BRIEF DESCRIPTION OF THE DRAWINGS

The characteristics and advantages of the present invention appear more clearly from the following description made by way of non-limiting indication and with reference to the accompanying drawings, in which.

DETAILED DESCRIPTION OF A PREFERRED EMBODIMENT

Figure 1:
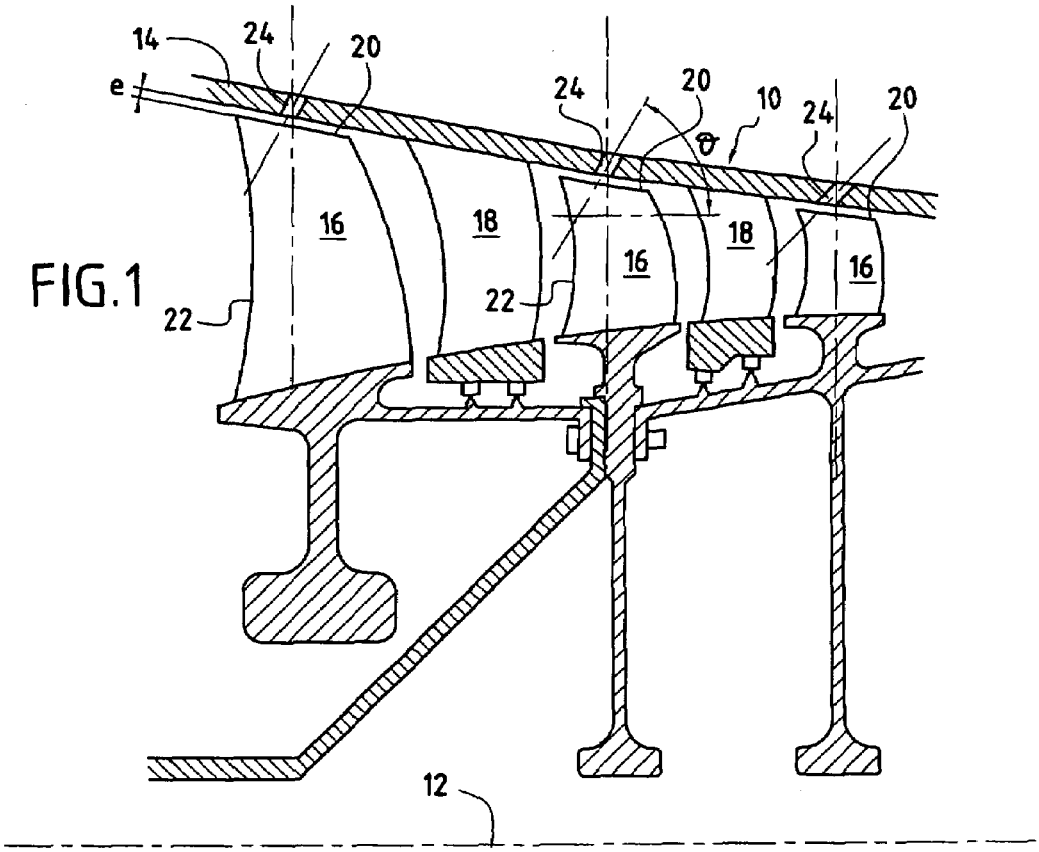
FIG. 1 is a diagrammatic fragmentary view of a section of a compressor in accordance with the invention comprising a plurality of moving blade stages each lying between two stages of stationary vanes.

FIG. 1 is a diagrammatic view of a section of a high pressure axial compressor 10 disposed around a longitudinal central axis (drive axis 12) of a turbomachine, and defined on its outside by a casing 14 forming a surface of revolution around the central longitudinal axis. The compressor comprises a plurality of compression stages in succession (in an axial direction), each stage comprising, distributed around an entire circumference, a plurality of moving or "rotor" blades 16 capable of turning about the drive axis, and a plurality of stationary or "stator" vanes 18. Clearance e exists between the outer tip 20 of each moving blade and the stationary casing 14 that surrounds the compressor. This clearance can be the site of violent turbulence that can deteriorate the flow configuration between these various stages and can thus lead to degraded performance of the compressor, or in the extreme can lead to a phenomenon that is known as "pumping" or "separation" constituted by an immediate drop in the compression ratio and a reversal of the flow of air passing through the compressor which then exits from the upstream end of the compressor.

In the invention, the operating safety margin relative to pumping is increased by adding an air bleed device disposed at the tips of the moving blades, i.e. substantially in the vicinity of their leading edges 22.

This bleed device comprises a plurality of holes 24 that are preferably cylindrical and formed through the stationary casing 14, being centered in the range 5% to 50% of the chord length of the blade and of a diameter that is less than or equal to 30% of the blade chord length, where the chord of the blade is the straight line segment connecting the leading edge to the trailing edge of a moving blade. The number of bleed holes is determined as a function of the air bleed rate compared with the total flow rate of air passing through the compressor. Typically bleeding off air at a rate lying in the range 0.1% to 5% guarantees that the device operates effectively, as has been determined by various measurements performed by the inventors.

Figure 2:
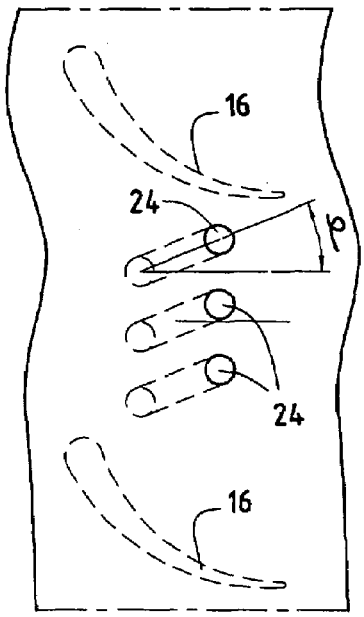
FIG. 2 is a plan view of the FIG. 1 casing in a first embodiment of the invention.

These bleed holes slope at two angles, defined by a first axis projected onto the blade-to-blade plane that presents an angle $\phi$ relative to the drive axis lying in the range 30° to 90° (see FIG. 2), and by a second axis projected onto the meridian plane (perpendicular to the first plane) that presents an angle $\theta$ relative to the drive axis lying in the range 30° to 90°. The optimum angles $\phi$ and $\theta$ are selected in particular as a function of the desired aerodynamic load (i.e. the air compression work delivered by the rotor, as given by the following relationship:

$$\psi=\Delta H/V^2$$

where $\Delta H$ is the increase in enthalpy on passing through the rotor and V is the speed of rotation of the compressor.

Naturally, this cylindrical configuration of the bleed holes and this linear disposition in a single row are not limiting.

Figure 3:
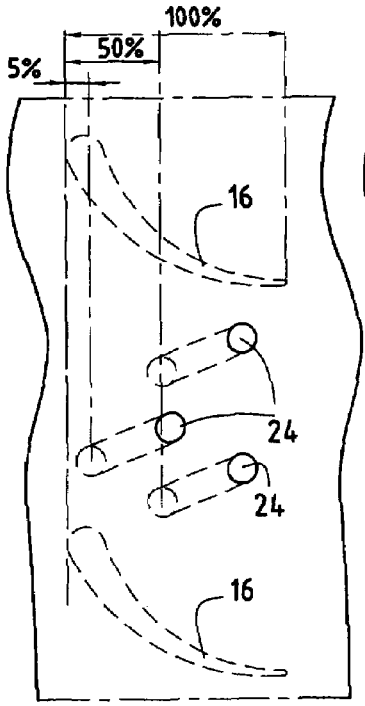
FIG. 3 is a plan view of the FIG. 1 casing in a second embodiment of the invention.
Figure 4:
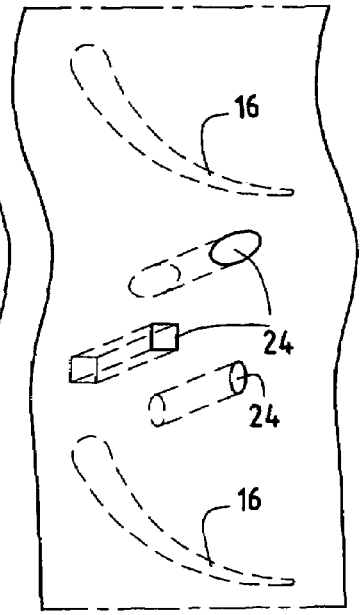
FIG. 4 is a plan view of the FIG. 1 casing in a third embodiment of the invention.

FIG. 3 shows an example of a disposition of the bleed holes in two rows, the holes being disposed in a staggered configuration within the above-defined limits of 5% to 50% of the blade chord length. In FIG. 4, these bleed holes are of non-circular shape, e.g. being square or oblong in section.

It is also possible to envisage having bleed holes in the form of axially symmetrical slots. With these embodiments of the present invention, the air that would conventionally pass through the clearance e over the tips 20 of the moving blades because of the pressure difference that exists between the concave and convex faces of the blades is instead sucked out in part via the bleed holes 24. This decrease in the interfering flow between the two faces of a single blade has the immediate effect of increasing the stability and the performance of the compressor. In addition, the bled-off air can be taken, possibly via a system of protective metal sheets (not shown), and reunited with the air taken by the existing bleed collectors of the turbomachine for drive or other purposes, e.g. for avionics.

Figure 6:
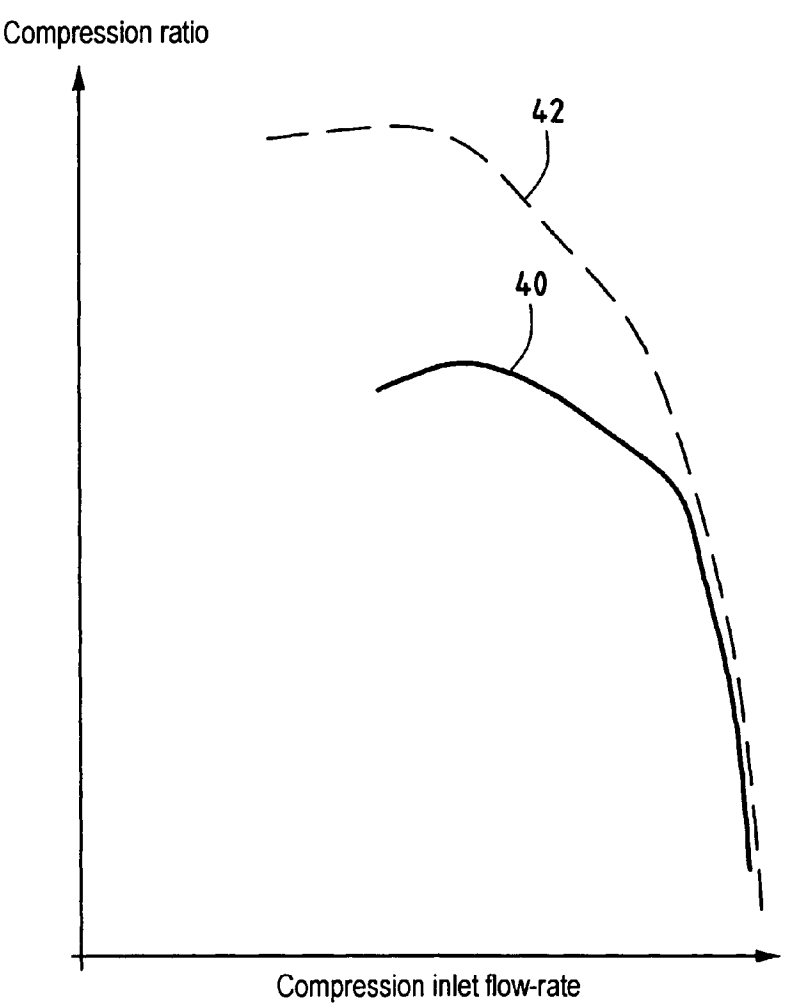
FIGS. 5 and 6 are graphs plotting variation in compression ratio as a function respectively of efficiency and of inlet flow rate for a prior art compressor and for a compressor of the invention.
Figure 5:
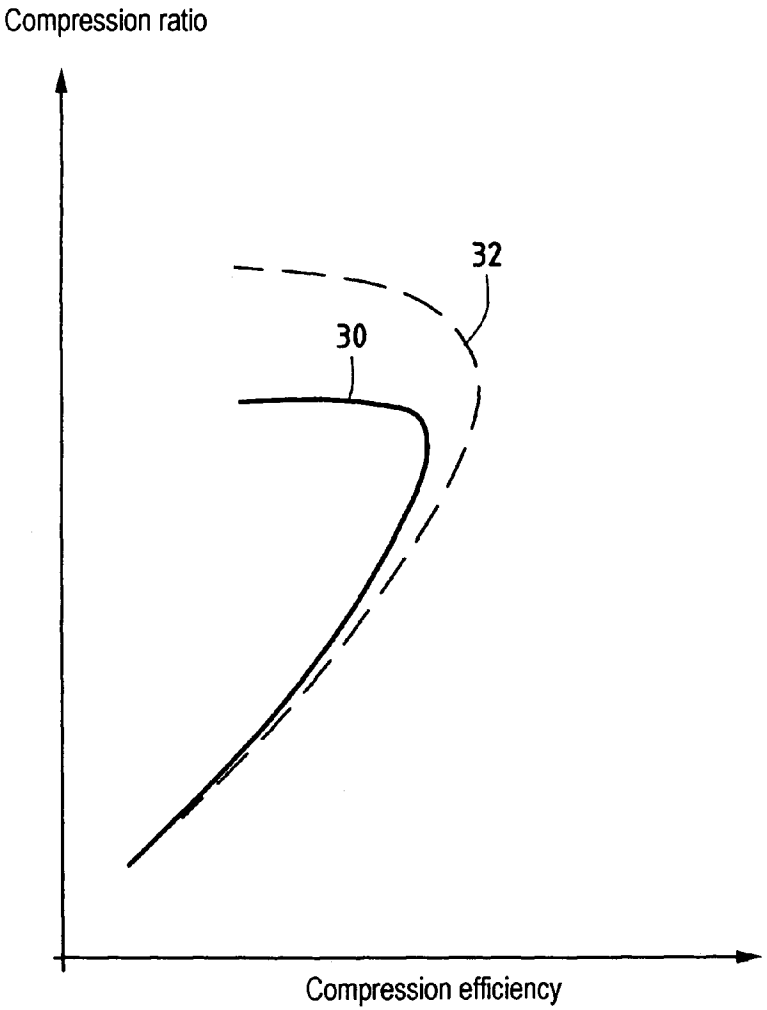

Thus, the improvement obtained by this bleed device is particularly significant and provides a considerable increase in the efficiency of the blade and in the operating range of the compressor as shown in FIG. 5 which plots variation in compression ratio as a function of the efficiency of the compressor for a prior art compressor (curve 30) and for a compressor provided with a device of the invention (curve 32), and as illustrated by FIG. 6 which shows variation in compression ratio as a function of the inlet flow rate to the compressor for a prior art compressor (curve 40) and for a compressor fitted with the device of the invention (curve 42).

Figure 7:
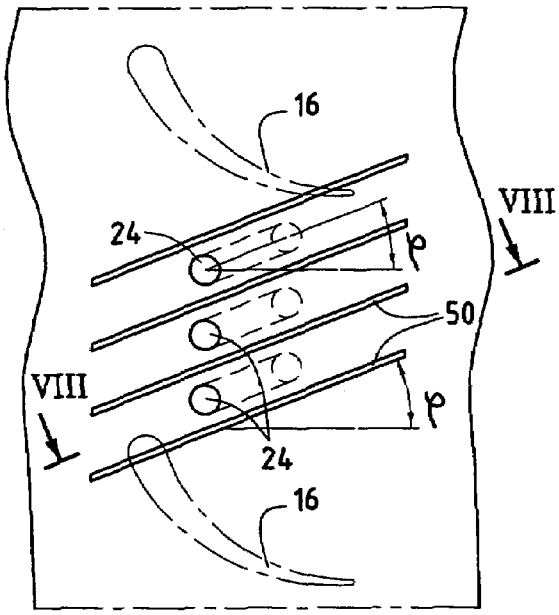
FIG. 7 is a view of the inside of the FIG. 1 casing in a variant of the first embodiment of the invention.
Figure 8:
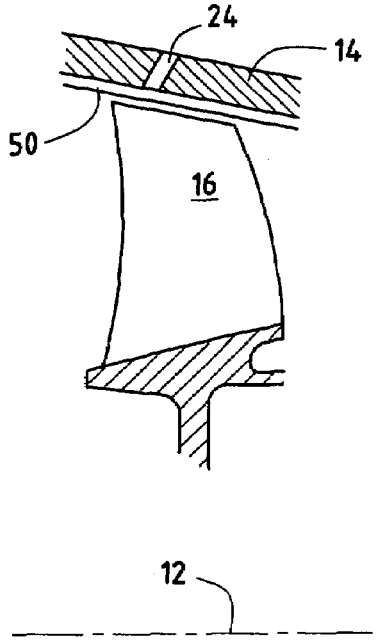
FIG. 8 is a section view on plane III-III of FIG. 7.

The effectiveness of the device can be further improved by orienting the air directly towards the bleed holes as shown in FIGS. 7 and 8, where there can be seen additional oblique tongues 50 placed on the stationary casing in register with the plurality of moving blades and on either side of each bleed hole 24. These tongues can be machined directly in the casing or they can be fitted thereon, and they are oriented at the same angle $\phi$ relative to the drive axis 12 as are the bleed holes.

Figure 9:
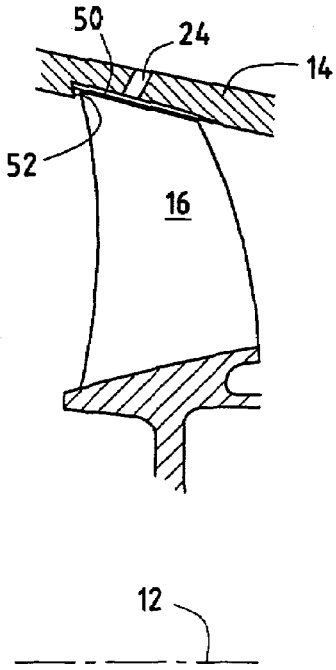
FIG. 9 is a section similar to the section of FIG. 7 for a first variant embodiment of the casing.
Figure 10:
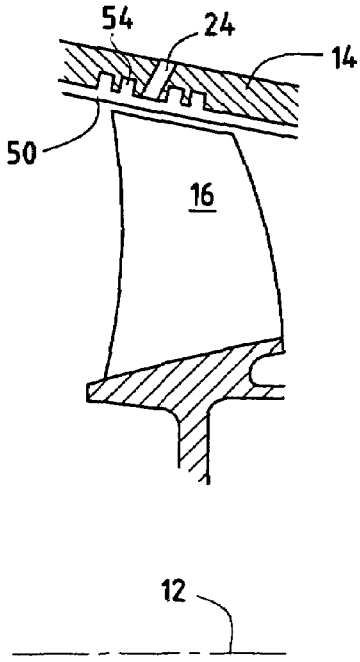
FIGS. 10 and 11 are views similar to the view of FIG. 9 for two other variant embodiments of the casing.
Figure 11:
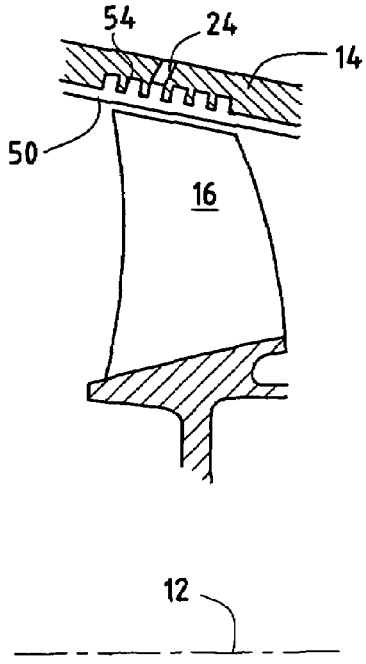

It should be observed that like the other configurations, this configuration can be installed on a casing 14 having a setback in register with the blades (referred to as a "trench" 52) as shown in FIG. 9, or can have grooving 54 in register with the blades (referred to as casing treatment) as shown in FIGS. 10 and 11. In FIG. 10, it can be seen that the grooving is distributed around the bleed hole 24, whereas in FIG. 11, the bleed hole opens out into the bottom of the grooving.

Naturally, although the above description relates essentially to a high pressure axial compressor, the device of the invention can also be applied to one or more transonic stages of a high pressure compressor or to a low pressure compressor. Similarly, the present invention is not limited to the moving blade mounting and drive structure shown in FIG. 1, and it is entirely possible to envisage using a structure making use of pin or hammer blade-attachment means.

What is claimed is:

1. A turbomachine compressor comprising at least one plurality of moving blades and, spaced apart therefrom in an axial direction relative to a central longitudinal axis of the turbomachine, a plurality of stationary vanes, and a stationary casing surrounding said plurality of moving blades, wherein said stationary casing includes a plurality of bleed holes passing through said stationary casing so that an inside of said stationary casing is in flow communication with the outside of said stationary casing via said bleed holes and, when said moving blades move inside said stationary casing during normal operation of said turbomachine, air is sucked outside of said stationary casing via said bleed holes, wherein said bleed holes are centered in a range of 5% to 50% of a blade chord length of each blade, said blade chord length being defined by a straight line segment connecting a leading edge to a trailing edge of each blade, wherein said range of 5% to 50% define limits for said bleed holes such that no bleed hole is centered outside of the range of 5% to 50%, and wherein said bleed holes are of a cross section largest length less than or equal to 30% of said blade chord length, each of said bleed holes sloping at two angles relative to said longitudinal central axis.

2. A turbomachine compressor according to claim 1, wherein each of said bleed holes has a first axis of inclination presenting an angle $\phi$ relative to the central longitudinal axis lying in the range 30° to 90°, and a second axis of inclination perpendicular to the first and presenting an angle $\theta$ relative to the central longitudinal axis lying in the range 30° to 90°.

3. A turbomachine compressor according to claim 2, wherein said stationary casing further includes oblique tongues disposed in register with said plurality of moving blades on either side of each bleed hole and oriented at said angle $\phi$.

4. A turbomachine compressor according to claim 1, wherein the ratio between the total air flow rate through the turbomachine and the bled-off air flow rate lies in the range 0.1% to 5%.

5. A turbomachine compressor according to claim 1, wherein said stationary casing further includes grooving disposed around each bleed hole.

6. A turbomachine compressor according to claim 1, wherein said bleed holes are disposed in a staggered configuration.

7. A turbomachine compressor according to claim 1, wherein said bleed holes are non-circular.

8. A turbomachine compressor according to claim 1, wherein said bleed holes are formed by axially-symmetrical slots.

9. A turbomachine including a high pressure axial compressor according to claim 1.

10. A turbomachine compressor according to claim 1, wherein said bleed holes have a circular cross section with a diameter less than or equal to 30% of said blade chord length.

11. A turbomachine compressor according to claim 1, comprising a plurality of compression stages in axial succession, each stage including a plurality of moving blades, a plurality of stationary vanes, and said stationary casing defining bleed holes such that for each stage of said plurality of compression stages, said bleed holes are centered in the range of 5% to 50% of the blade chord length of moving blades corresponding to said each stage.

12. A turbomachine compressor according to claim 1, further comprising oblique tongues on said stationary casing, said oblique tongues being configured to orient air directly towards the bleed holes.

13. A turbomachine compressor according to claim 12, wherein said oblique tongues are oriented at one of said two angles relative to said longitudinal central axis.

14. A turbomachine compressor according to claim 1, wherein said stationary casing defines a trench in register with the moving blades, wherein said bleed holes have an inlet at said trench.

15. A turbomachine compressor according to claim 1, wherein said stationary casing defines a grooving in register with the moving blades.

16. A turbomachine compressor according to claim 15, wherein said grooving is distributed around said bleed holes.

17. A turbomachine compressor according to claim 15, wherein said bleed holes open out into a bottom of said grooving.

18. A turbomachine compressor according to claim 1, wherein one of said two angles is defined between the drive axis and a first axis projected onto a blade-to-blade plane, and another one of said two angles is defined between the drive axis and a second axis projected onto a plane perpendicular to said blade-to-blade plane.

19. A turbomachine compressor according to claim 1, wherein said bleed holes are cylindrical and have a circular cross section with a diameter less than or equal to 30% of said blade chord length.

20. A turbomachine compressor according to claim 1, wherein said air sucked out of the stationary casing via said bleed holes is reunited downstream of said bleed holes with bleed air from said compressor.

21. A turbomachine compressor according to claim 20, wherein said air sucked out of the compressor is directed toward avionics.

* * * * *